United States Patent [19]

Dickson

[11] 4,138,752

[45] Feb. 13, 1979

[54] MARINE BUOY

[75] Inventor: Peter G. Dickson, Cowes, England

[73] Assignee: Marine Exploration Limited, Cowes, England

[21] Appl. No.: 787,517

[22] Filed: Apr. 14, 1977

[30] Foreign Application Priority Data

Apr. 26, 1976 [GB] United Kingdom ..... 16799/76

[51] Int. Cl.[2] ..... B63G 21/52

[52] U.S. Cl. ..... 9/8 R; 114/140; 114/230

[58] Field of Search ..... 9/8 R, 8 P, 8.3 R, 8.3 E; 114/230, 140; 340/2; 73/170 A

[56] References Cited

U.S. PATENT DOCUMENTS

| | | | |
|---|---|---|---|
| 3,167,793 | 2/1965 | Keats | 9/8 R |
| 3,369,516 | 2/1968 | Pierce | 9/8 R X |
| 3,404,413 | 10/1968 | Clark | 9/8 R |
| 3,605,492 | 9/1971 | Stohrer et al. | 9/8 R |
| 3,961,259 | 6/1976 | Elstow | 9/8.3 R |

*Primary Examiner*—Galen L. Barefoot
*Assistant Examiner*—Sherman D. Basinger
*Attorney, Agent, or Firm*—Weingarten, Maxham & Schurgin

[57] ABSTRACT

A small, wave-following, relatively stable marine buoy designed for floating at the surface of a body of water and for carrying data measuring equipment. The buoy comprises a buoyant hull member of substantially cylindrical configuration of relatively small axial extent, a mast, and a keel. The keel comprises a spar and a ballast weight attached to the spar. Both the mast and the keel are guyed to the hull at opposite ends thereof, and supported thereagainst by couplings which do not transfer bending moment between the hull and each of the mast and spar.

16 Claims, 2 Drawing Figures

MARINE BUOY

The invention relates to a marine buoy designed for floating at the surface level of a body of water and for carrying data measuring equipment.

Such type of buoy, often referred to as a data buoy, is applied at sea or in the ocean (mostly at a fixed location) to collect data of meteorological and/or marine (or oceanographic) nature such as information on speed and direction of wind, wave height, barometric pressure, sea temperature, air temperature, sea level, speed and direction of current, all such information being measured in relation to time.

A great number of designs for buoys for general purpose as well as for the particular purpose of collecting marine data have been made up already. However, although the majority of the designs of data buoys was found to be useful in operation for the collection of information on a limited number of parameters, improvements in buoy designs were found to be required where a large number of parameters were to be measured without increasing the size and cost of the buoy excessively and at the same time not reducing the stability of the buoy and the ability to survive and operate in extremely bad conditions, such as existing in areas where heavy storms are found to occur frequently.

The following types of marine buoys for collecting meteorological and oceanographic data can be distinguished.

The spar-buoy comprises a slender buoyant hull member which may have a length up to ninety meters. The major part of the hull member is outside the wave zone and due to inertia such buoy will not or hardly not be subjected to vertical displacements under influence of wave action. Therefore, such buoys form a stable base for mounting measuring equipment thereof, but drawbacks are their high price, and the fact that they are difficult to be transported due to their great length.

Spar-type buoys of relative small vertical length (say from five to fifteen meters) do not show these drawbacks but are found to be less stable when influenced by large waves. Under such conditions they show an insufficient righting moment which makes them heel towards the flanks of the passing waves, thereby rendering them unsuitable for measuring wind parameters.

A similar drawback is met when mounting the data collecting means on or in a spherical hull that is provided with a spar. Such hull will oscillate to a large extent when being subjected to wave action and has in practice found to be attractive only for measuring wave heights by means of an acceleration measuring device in combination with a double integrator. A plain sphere shows a better behaviour but — in the absence of a mast — cannot be used for measuring wind parameters.

Further, buoys having floating hull members of cylindrical shape and having dimensions corresponding to those of a small vessel have been used for carrying marine and meteorological data measuring equipment. Buoys of this type are wave following buoys just as the spherical buoy. Due to the size thereof, they are relatively stable and are suitable for detecting wind parameters, such as speed and direction. Since being of large dimensions (the hull diameter being in the range between 6 and 15 meters and the height of the hull ranging from 2 to 3 meters) these buoys are difficult to handle and expensive in manufacturing due to their large size and weight.

All the known buoys may be applied as drifting buoy or at a fixed location by being moored to the sea or ocean bottom. The data collected by the marine and meteorological measuring equipment carried by the buoys is either stored aboard the buoy and removed therefrom periodically by operators visiting the buoys by means of a vessel or helicopter, or transmitted either continuously or periodically by radio waves to shore-based receivers. The buoys are then visited for maintenance and energy supply purposes only.

Object of the present invention is a marine buoy of relatively small dimensions, that is relatively cheap to manufacture and easy to handle, is wave-following under operating conditions, but notwithstanding the relatively small size thereof sufficiently stable to allow accurately recording of parameters above sea water level such as wind parameters, air temperature, barometric pressure, visbility and rainfall.

According to one aspect of the invention, a marine buoy comprises a buoyant hull member of substantially cylindrical configuration, a mast and a keel guyed to opposite ends of the hull member, said keel consisting only of a spar and a ballast weight attached to said spar.

According to another aspect of the invention, the keel ballast is supported by the hull member by means of supporting members stressed under compressive loads.

The diameter/height ratio of the hull member may be between 2 and 6 and is preferably between 3 and 4.

The diameter of the hull may be between 2 and 4 meters, and is preferably between 2 and 3 meters.

The distance between the ballast weight and the hull member is between 1 and 5 times the diameter of the hull member, and is preferably between 2 and 4 times this diameter. The ballast weight may be between $\frac{1}{3}$ and 1/7, and is preferably between $\frac{1}{4}$ and 1/6 of the all up weight of the buoy.

The hull member may be provided with at least one free-flooding well extending between flat ends of the hull member and suitable for housing a water-proof module containing electronic equipment.

The invention will be described in more detail by way of example with reference to the drawing which shows some embodiments of the invention.

Figure 1:
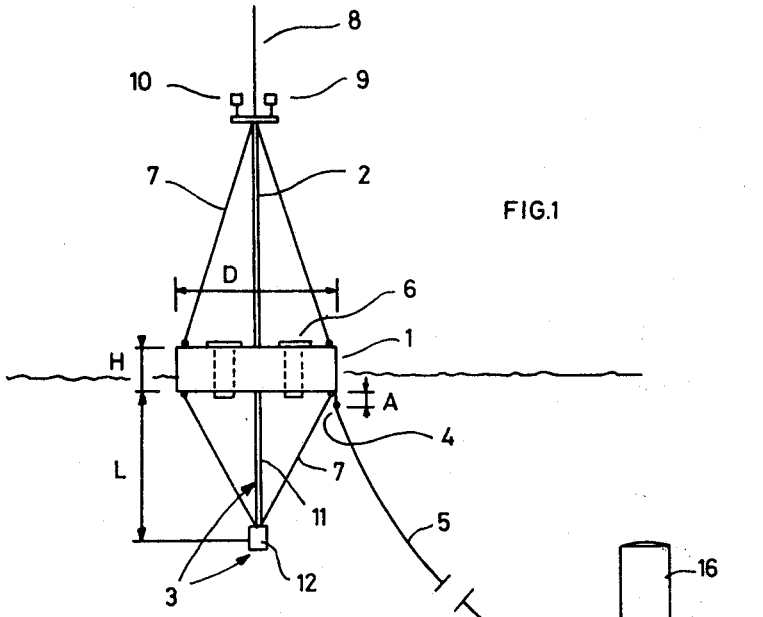
FIG. 1 shows a marine buoy of the present invention in a position moored to the sea bottom.

The buoy shown in FIG. 1 consists of a hull member 1, a mast 2, a keel 3, and attachment means 4 for connecting the hull member 1 to a mooring line 5. The hull member 1 carries a plurality of modules 6 containing electronic equipment. Details of the way in which the modules are carried by the buoy will be described hereinafter with reference to FIG. 2 of the drawing.

The mast 2 and the keel 3 are each guyed to the hull member 1 by means of a plurality (at least three) guys 7, that are attached to the hull member and to the keel and the mast in one of the manners known per se, which manners do not need any further description. The same applies for the tensioning means used for tensioning the guys.

The top of the mast 2 carries an aerial 8, a wind speed sensor 9 and a wind direction sensor 10. All these elements are of known design and do not require a detailed description. The sensors 9 and 10, as well as other sensors (not shown) are in electric communication with the electronic equipment in one of the modules 6 through the intermediary of water-tight electric cables and couplings (not shown).

The keel 3 of the buoy consists of a spar 11 and a ballast weight 12. The keel may either consist of two separate parts or the spar and ballast weight may be in one piece.

It is observed that the keel 3 only consists of the spar and the ballast weight and that stabilizing means, e.g., in the form of horizontal discs to obstruct vertical movements of the buoy, or in the form of vertically extending plates to obstruct oscillating movements of the buoy are not present since such means have been found to undesirably influence the vertical position of the buoy when subjected to water current. The buoy when moored would then be loaded by a mooring line force and by the force exerted by the water current on the stabilizing means and consequently heel, thereby changing the position of the wind sensors 9 and 10 which would as a result thereof give off data not representative for the existing wind conditions.

When applying the buoy according to the invention on locations where considerable wave action is to be expected, the dimensions of the buoy should be carefully chosen in order to decrease the sensitivity of the buoy to oscillating movements resulting from wave action, since such movements would undesirably influence the measuring results in particular of those sensors that are carried by the mast of the buoy at a relatively large distance above the water level.

The hull member should have a diameter/height (D/H) ratio between 2 and 6. The exact ratio depends on the particular wave type of the sea or ocean where the buoy is to be used. In general, good results will be obtained by a D/H ratio between 3 and 4.

The same applies for the ratio L/D indicating the relationship between the distance L at which the centre of gravity of the ballast weight 12 is placed from the side of the hull member 1 facing the ballast weight 12 and the diameter D of the full member 1. This ratio should be between 1 and 5. The exact ratio depends on the wave type on the location where the buoy will be applied. Good stability will be reacted at a L/D ratio between 2 and 4.

The ratios referred to above allow the use of a buoy of small dimensions without undesirably influencing its stability. A hull diameter between 2 and 4 meters (preferably between 2 and 3 meters) can be applied, which allows the construction of a stable buoy of dimensions sufficiently small for easy transport and handling.

The ballast weight may be between $\frac{1}{3}$ and 1/7 (preferably between $\frac{1}{4}$ and 1/6) of the all up weight of the buoy.

To counteract heeling of the moored buoy under influence of water current, the ratio L/A should be between 10 and 20 (preferably between 13 and 16). As already observed L denotes the distance between the centre of gravity of the ballast weight 12 and the end of the buoy member 1 facing the ballast weight. Further, A denotes the distance between the attachment means 4 for the mooring line 5 and the circumference of the end of this body 1 facing the means 4.

The mooring line 5 is connected by means of a swivel coupling 13 to the taut line 14 extending between a weight member 15 and an underwater buoy 16.

Figure 2:
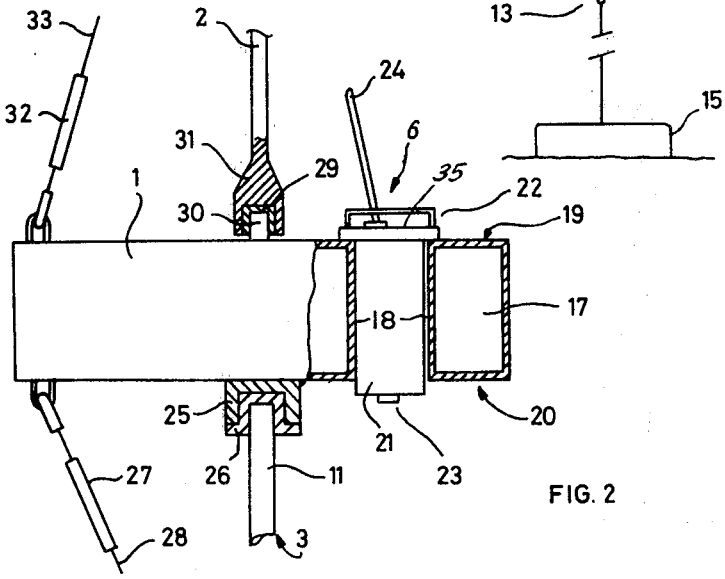
FIG. 2 shows on a larger scale than FIG. 1, part of the buoy of FIG. 1, partly in side view and partly in cross-section.

FIG. 2 shows details of the way in which the modules 6 are supported by the hull member 1.

The hull member 1 is a rigid hollow metal construction designed for floating on the water surface even under storm conditions. The interior 17 may be filled with a resin foam having the pore space thereof filled with a gas. The hull member may be made of metal or reinforced resin.

A free flooding well 18 consisting of a tubular member (which may be of circular cross-section) is arranged between end face 19 and end face 20 of the cylindrical hull member 1. End faces 19 and 20 are substantially parallel, spaced, disc-shaped end members which have a continuous flat surface at least in the vicinity of the axis of the hull member. A module 6 is suspended in the well 18 and connected to the hull 1 by means known per se. The module 6 is a water-tight container 21 provided with a lifting handle 22 on top thereof and adds to the buoyancy of the buoy. Electronic equipment (not shown) is contained in the container 21 for operating measuring equipment co-operating with a sensor 23 mounted on the bottom end of the container 21. An electric cable 24 passes fluid-tightly through the top end 35 of the container 21 and leads to the aerial 8 (see FIG. 1).

It will be understood that the energy required for operating the electronic equipment may be in any suitable form, such as in the form of batteries that are situated in the various modules, or contained in a separate module that is coupled by electric cables to those modules containing the electronic equipment.

Although the embodiment shown in FIG. 1 shows an aerial for transmitting the collected data to a receiver either located on-shore or on a nearby ship, it will be understood that the data may also be stored in digital or analogue form on tape in the modules, and be collected periodically by replacing the modules by modules containing a supply of fresh tape.

It will be appreciated that the way of mounting the sensor 23 allows measurement of underwater parameters. If desired, further sensors may be mounted on the top end of the modules for measuring parameters above the water level. Sensors mounted on the buoy itself (such as sensors 9 and 10 in FIG. 1) or at some distance from the buoy are coupled to a module by means of electric cables for transmitting the measured data to the module.

A cheap construction of the buoy which is accompanied by a considerable reduction in weight of the buoy and at the same time allows easy transport and storage thereof will be obtained by mounting the mast 2 and/or the keel 3 on the hull member 1 in the manners shown in FIG. 2 of the drawing.

The lower end 20 of the hull member 1 has a receptacle 25 connected thereto (e.g., by welding) in the vicinity of the axis of the hull, which receptacle contains a cup-shaped member 26 of flexible material (e.g., rubber). The upper end of the spar 11 fits in the cup-shaped member 26 and is pressed into the cup under influence of the tensioning load exerted by spanners 27 in the guys 28 by which the keel 3 is guyed to the hull member 1.

In an alternative manner, the mast 2 is held in contact with the hull member 1, through the intermediary of a flexible cup 29 situated between a pin 30 welded onto the upper end 19 of the hull member 1 in the vicinity of the axis of the hull, and a receptacle 31 forming the lower end of the mast 2. Spanners 32 in guys 33 force the lower end of the mast 2 onto the hull member 1. At least a portion of each of the couplings described above is mounted to one of end face members 19, 20, as is shown clearly in FIG. 2.

The load between the upper end 19 and the lower end 20 of the hull member is taken up by stiffening plates (not shown) located in the interior of the hull member 1.

It will be appreciated that the flexible cups 26 and 29 prevent the hull member from being loaded by bending moments variable in magnitude and direction and resulting from lateral loads exerted on the mast 2 and the keel 3. Mounting the mast and keel in a fixed manner on the hull member 1 would require intricate and heavy constructions to prevent fatigue failure of such mountings resulting from the alternate load pattern exerted thereon. The present solution obviates this problem and leads to a buoy construction showing the advantages that are referred to above.

It will be understood that the two alternative manners of mounting the spar and the mast in FIG. 2 are shown by way of example only. Any other construction that prevents loading the coupling between the hull member and the mast and/or the keel by bending moments will give good results. In general, this will be reached by interposing flexible means between the hull member and the lower end of the mast (and/or the upper end of the keel). If desired, a pin or bolt may be passed laterally through the receptacle 25, the flexible cup 26 and the upper part of the spar 11, provided that such pin (or bolt) has sufficient play to obviate the passage of any load therethrough between the spar and the receptacle. The application of such pin (or bolt) may be useful when mounting the spar to the hull member.

Further, the use of the buoy of the present invention is not restricted to the way in which it is moored to the sea or ocean bottom. Mooring systems other than the one shown in FIG. 1 may be applied. If desired, the buoy may even be used free-drifting.

What we claim is:

1. A marine buoy for floating at the surface of a body of water and carrying data measuring equipment, comprising a buoyant, rigid hull member of substantially cylindrical configuration, a mast, a keel wherein said keel further comprises a spar and a ballast weight attached to said spar, a plurality of guy wires having tensioning means for guying each of said mast and said spar to opposite ends of said hull member, a first coupling mounted externally on one end of said hull member for coupling an end of said mast to said hull member, a second coupling mounted externally on the opposite end of said hull member for coupling an end of said spar to said hull member, each of said couplings including a flexible or resilient member, said flexible members being disposed between said hull and the ends of said mast and said spar adjacent said hull respectively, whereby said guy wires are under tension and the coupled ends of said mast and said spar are compressively loaded resulting from the tension in said guy wires, said flexible members in combination with said rigid hull member and guy wires avoid substantially any transfer of bending moment between said hull member and said mast and said spar.

2. The buoy of claim 1 wherein the diameter-to-height ratio of said hull member is between 2 and 6.

3. The buoy of claim 2 wherein the diameter-to-height ratio is between 3 and 4.

4. The buoy of claim 2 wherein the diameter of said hull member is between 2 and 4 meters.

5. The buoy of claim 4 wherein the diameter of said hull member is between 2 and 3 meters.

6. The buoy of claim 5 wherein the length of said spar is between 1 and 5 times the diameter of said hull member and the ratio of the ballast to the all up weight of the buoy is between 1:3 and 1:7.

7. The buoy of claim 6 wherein the length of said spar is between 2 and 4 times the diameter of said hull member and the ratio of the ballast to the all up weight of the buoy is between 1:4 and 1:6.

8. The buoy of claim 1 further including means mounted near the circumference of said hull member and at the end thereof facing said keel, for attaching the buoy to a mooring line, such that the ratio between the distances at which the ballast weight and the attachment means are positioned from said hull member is between 10 and 20.

9. The buoy of claim 8 wherein the ratio between the distances. at which said ballast weight and said attachment means are positioned from said hull is between 13 and 16.

10. The buoy of claim 8 further including at least one free-flooding well arranged in said hull member, extending between opposite ends of said hull member and adaptable for receiving a waterproof module containing electronic equipment.

11. The buoy of claim 10 wherein said free-flooding wells are cylindrical in cross-section.

12. The buoy of claim 10 further including a waterproof module disposed in said well, said module containing electronic equipment connected to at least one sensor mounted on an end thereof and having means for handling arranged at an opposite end thereof.

13. The buoy of claim 1 wherein at least one of said couplings comprises a receptacle having a cup-shaped interior surface which cooperates with a member inserted therein, the flexible member including a flexible material contained within the coupling between said inserted member and the interior surface of the receptacle.

14. The buoy of claim 13 wherein said at least one of said couplings retains said keel spar, said inserted member comprising an end of said spar.

15. The buoy of claim 13 wherein said at least one of said couplings retains said mast, said inserted member being attached to and extending outwardly from said hull, said receptable being formed in an end of said mast.

16. The buoy of claim 1 wherein said hull member is formed with substantially parallel spaced disc-shaped end members formed with a continuous flat surface in the vicinity of the axis of said hull member, wherein a portion of said first coupling is mounted to one of said end members substantially on said axis, a portion of said second coupling is mounted on the other of said end members substantially on said axis, the respective ends of said mast and said spar adjacent said hull member being spaced by at least the distance between said end members.

* * * * *